US008991325B2

(12) United States Patent
Yemm et al.

(10) Patent No.: US 8,991,325 B2
(45) Date of Patent: Mar. 31, 2015

(54) MARINE CONNECTION SYSTEM AND METHOD

(75) Inventors: Richard William Yemm, Edinburgh (GB); Edward Charles Maycock, Edinburgh (GB); Martin Goldman Shaw, Perth (GB); Michael Collee, Edinburgh (GB); Elizabeth Anne Jane Dickens, Edinburgh (GB)

(73) Assignee: Pelamis Wave Power Limited, Edinburgh (GB)

( * ) Notice: Subject to any disclaimer, the term of this patent is extended or adjusted under 35 U.S.C. 154(b) by 669 days.

(21) Appl. No.: 13/001,647

(22) Filed: Mar. 7, 2011

(65) Prior Publication Data

US 2011/0168075 A1 Jul. 14, 2011

(30) Foreign Application Priority Data

Jul. 9, 2008 (GB) ..... 0812553.6

(51) Int. Cl.

| | |
|---|---|
| ***B63B 21/56*** | (2006.01) |
| ***B63B 21/16*** | (2006.01) |
| ***B63B 27/24*** | (2006.01) |
| ***E21B 19/16*** | (2006.01) |
| ***E21B 41/00*** | (2006.01) |

(52) U.S. Cl.

CPC ..... *B63B 21/16* (2013.01); *B63B 27/24* (2013.01); *E21B 19/16* (2013.01); *E21B 41/0007* (2013.01)

USPC ..... 114/249; 114/268; 114/230.12

(58) Field of Classification Search

USPC ..... 441/3–5; 114/266, 267, 268, 269, 65 R, 114/230.12, 249

See application file for complete search history.

(56) References Cited

U.S. PATENT DOCUMENTS

| | | | | |
|---|---|---|---|---|
| 3,685,133 | A * | 8/1972 | Simon | 29/426.2 |
| 3,786,525 | A * | 1/1974 | Christians et al. | 441/3 |
| 5,044,297 | A * | 9/1991 | de Baan et al. | 114/293 |
| 5,456,622 | A * | 10/1995 | Breivik et al. | 441/3 |

(Continued)

FOREIGN PATENT DOCUMENTS

| | | | |
|---|---|---|---|
| EP | 1283158 | A1 | 2/2003 |
| GB | 2173160 | A | 10/1986 |
| GB | 2367049 | A | 3/2002 |

(Continued)

OTHER PUBLICATIONS

Weber, Ingo, "International Search Report", for PCT/GB2009/050732 as mailed Nov. 12, 2010, 6 pages.

*Primary Examiner* — Edwin Swinehart

(74) *Attorney, Agent, or Firm* — Winstead PC

(57) ABSTRACT

A connection system comprises a first latching (5) element mountable on or to a first body (3) and a second latching element (6) mountable on or to a second body (4), and means for drawing the first latching element and second latching element together to facilitate connection of the first body to the second body, said drawing means comprising a buoyant winching system (2). A connection method for connecting a first body carrying a first latching element to a second body carrying a second latching element, comprises the steps of connecting a winch line (11) from a buoyant winching system comprising a winch, through the first latching element to a tether line attached to the second latching element and operating the winch to draw the first and second latching element together to connect the first body to the second body wherein the connection of the winch line to the tether line is carried out without tension in the winch line.

20 Claims, 9 Drawing Sheets

(56) References Cited

U.S. PATENT DOCUMENTS

| | | | | |
|---|---|---|---|---|
| 7,510,452 | B2 * | 3/2009 | Van Tol et al. | 441/5 |
| 2002/0189522 | A1 | 12/2002 | Dove et al. | |

FOREIGN PATENT DOCUMENTS

| | | | |
|---|---|---|---|
| WO | WO-2004/027203 | A2 | 4/2004 |
| WO | WO-2004/096632 | A1 | 11/2004 |

* cited by examiner

MARINE CONNECTION SYSTEM AND METHOD

BACKGROUND

This invention relates to a connection system and a connection method and more particularly, relates to a sub-sea connection system and method which is adapted to facilitate connection and/or disconnection of a first body to a second body. The invention finds particular application in connecting a first body to a second body in an off-shore environment and is particularly adapted for use in moderate seas.

PRIOR ART

Connecting a marine structure to its mechanical moorings, electrical power, communication signals and/or fluid transmission is a common offshore activity. Current methods require connection work to be carried out either on the deck of a vessel or on the marine structure itself.

This connection activity in particular is sensitive to the weather conditions and can involve, as in the case of connecting mooring lines, working with taut lines under large loads. This is potentially dangerous work which must be carried out using a restrictive range of vessels and equipment, and a restrictive range of weather conditions, all factors increasing the expense of a project.

Furthermore the connection process is often a time-consuming one with each mooring line, electrical power, communications and fluid transmission cable being separately connected to the structure. This extends the length of weather window required for connection operations increasing the likelihood of delays and adding further to the cost.

In some cases, marine structures are towed to an installation location with the moorings already connected. In this case, large vessels are used to pull the anchors of the moorings into place on site.

Alternatively, when the marine structure reaches the required location, a winch line is connected from the marine structure to the mechanical mooring to draw the two together for mechanical connection. A winch may be permanently mounted on the marine structure to facilitate connection which increases the cost of the equipment required for each connection process. Alternatively, the winch may be provided on a towing vessel in which case it must be connected to each of the marine structure and mechanical mooring before the connection can be made. As mentioned above, this adversely affects the time taken for the connection process.

The present invention aims to address these problems and in particular aims to facilitate faster connection between a first body and a second body, such as for example a marine structure and a sub-sea umbilical or a floating cable and a mooring system, over a wider range of weather conditions, with fewer restrictions on the vessel requirements than known methods.

It is a further aim of the present invention to remove the requirement to handle taught lines or make complicated connections on deck. This will significantly improve the safety of such an operation.

SUMMARY OF INVENTION

According to one aspect of the present invention there is provided a connection system comprising a first latching element mountable on or to a first body and a second latching element mountable on or to a second body, and means for drawing the first latching element and second latching element together to facilitate connection of the first body to the second body, said drawing means comprising a buoyant winching system.

Preferably one of said first and second bodies is a marine structure and the buoyant winching system is mountable on or to said marine structure.

Conveniently the buoyant winching system is removably mountable on or to said marine structure.

Preferably said drawing means further comprises a winch line attached at one end to the winch and connectable at the other end to a tether line to which the second latching element is adapted to be connected.

Advantageously the winch line passes through the latching element of the first body.

Conveniently axial drive means are provided on the winch for maintaining correct spooling of the winch line.

Preferably means are provided for towing the first body the towing means comprising a towing line connected between the first body and a towing vessel and wherein the towing line is shorter than the winch line such that when the free end of the winch line is carried on the towing vessel, whilst the towing line is under tension, there is no tension in the winch line.

Advantageously the first latching element comprises a socket mounted on the first body, and the second latching element comprises a plug locatable within the socket of the first latching element.

Preferably alignment means are provided to enable correct axial and rotational alignment of the first and second latching elements.

Conveniently the second latching element is provided with buoyancy means to maintain the second latching element floating in an upright orientation at a chosen depth.

Preferably the winch is remotely operable.

In some embodiments the latching mechanism between the first and second latching elements may be remotely operable.

Advantageously the buoyant winching system comprises hoist means facilitating installation of the buoyant winching system into a preferred location on said first or second body.

Preferably mechanical locking means are provided between the first and second latching elements.

Preferably also a further locking means is provided between the first and second latching elements to avoid an unintentional disconnection of the first and second latching elements.

Conveniently the winch is provided with a power supply and/or a communications system which preferably is routed through the first body, particularly where the first body is a marine structure.

Advantageously the power supply of the winch can act as an auxiliary power source for the first body.

Preferably the first and second bodies include any combination or single function from the group comprising: an umbilical, for carrying electrical current, an optical fibre, for carrying an optical signal, a fluid transmission and a mechanical mooring.

Conveniently the connection system includes a viewing system. Preferably the viewing system relays images to an operator controlling the connection of the first body to the second body.

According to a further aspect of the present invention there is provided a connection method for connecting a first body carrying a first latching element to a second body carrying a second latching element, the connection method comprising the steps of connecting a winch line from a buoyant winching system through the first latching element to a tether line attached to the second latching element and operating the winch to draw the first and second latching elements together to connect the first body to the second body wherein the connection of the winch line to the tether line is carried out without tension in the winch line.

Due to the lack of tension in the first line when the connection is made between the first line and the tether line, the connection can be made in rougher seas than currently used connection methods and this therefore increases the weather window within which the connection between the lines can be made.

Preferably the buoyant winching system is mounted on or to said first body.

Preferably the first and second latching elements are mechanically locked together once they have been drawn together.

Conveniently the method further comprises the step of disconnecting or severing the winch line once the first and second bodies are connected.

Preferably also the method further comprises the step of removing the buoyant winching system from the first body.

BRIEF DESCRIPTION OF FIGURES

A preferred Embodiment of the Invention will now be described by way of example only and with reference to the Figures in which.

DETAILED DESCRIPTION OF PREFERRED EMBODIMENTS OF THE INVENTION

Figure 1A:
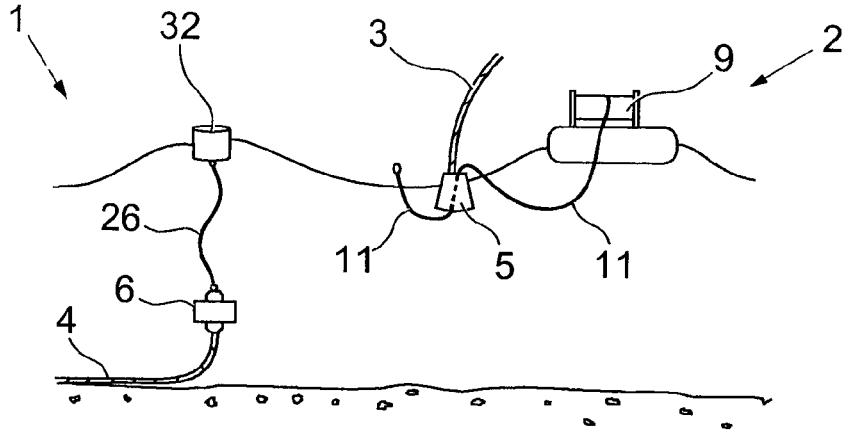
FIGS. 1*a*, 1*b* and 1*c* are schematic views illustrating the components of a sub-sea connection/disconnection system according to one aspect of the present invention.
Figure 1B:
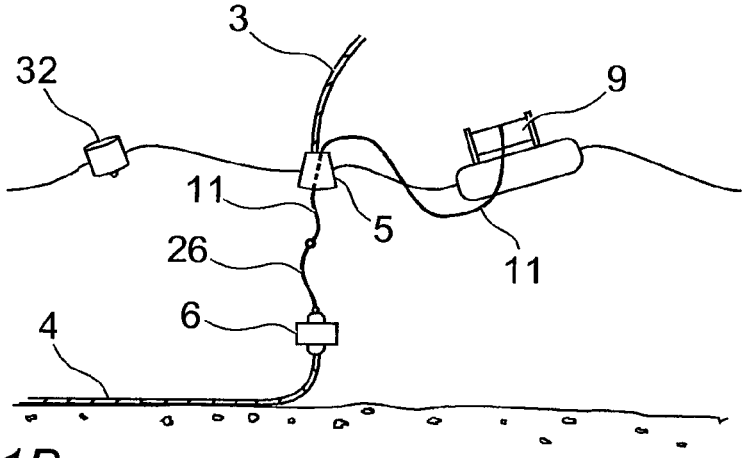
Figure 1C:
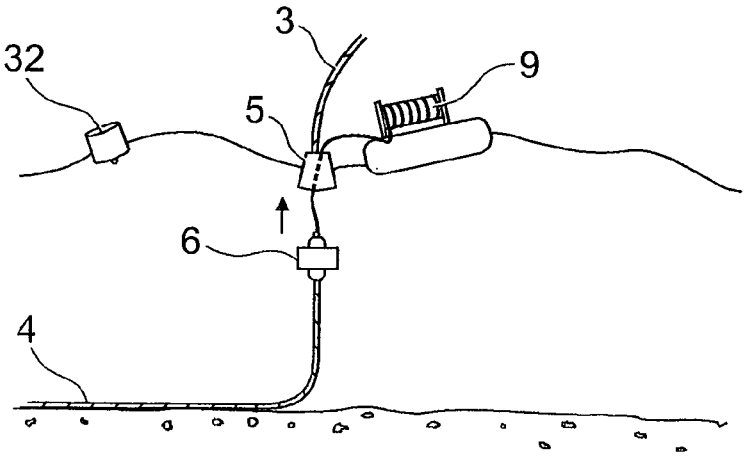

Turning now to the Figures, there is shown in FIG. 1 a connection system 1 according to a first aspect of the present invention. The connection system comprises a buoyant winching system 2 comprising a winch 9, which is adapted to be towed to an off-shore location by a tug or other vessel. A latching mechanism is provided for connecting a first cable or body 3 to a second cable or body 4. A first element 5 of the latching mechanism is mounted on the first cable or body and a second element 6 of the latching mechanism is connected to the second cable or body, this element remains permanently located at the connection site.

Figure 2A:
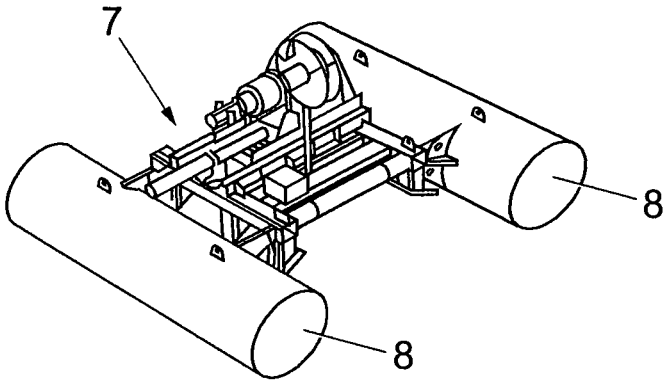
FIG. 2*a* is a perspective view from above of a buoyant winching system of the connection system of FIG. 1.
Figure 2B:
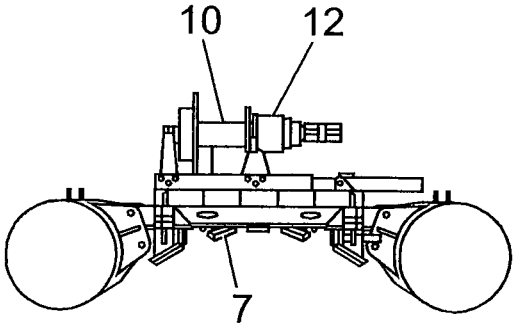
FIG. 2*b* is an end view of the buoyant winching system of FIG. 2*a;*
Figure 2C:
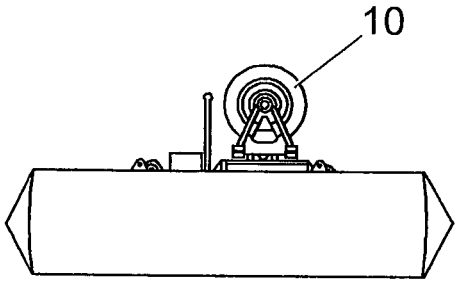
FIG. 2*c* is a side view of the buoyant winching system of FIG. 2*a;*
Figure 3A:
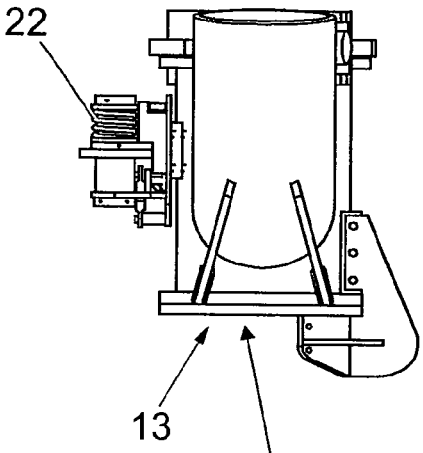
FIG. 3*a* is a side view of a first element of the latching mechanism of the connection system of FIG. 1.
Figure 3C:
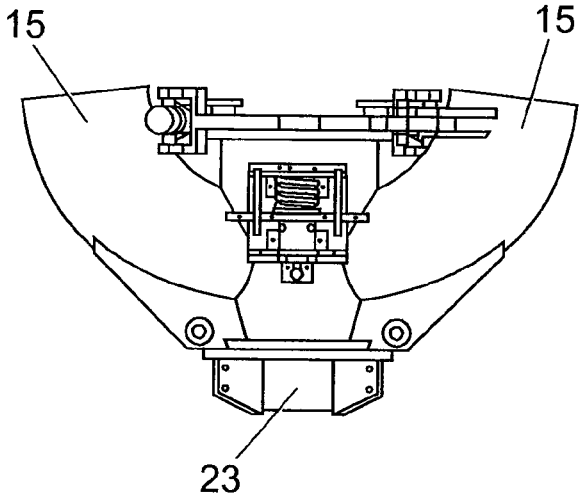
FIG. 3*c* is a front view of the first element of FIG. 3*a;*
Figure 3B:
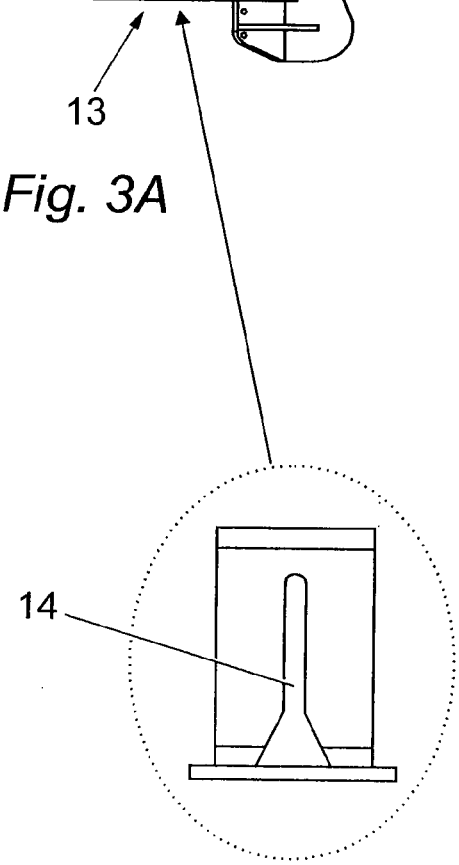
FIG. 3*b* is an enlarged detail of the internal features of the first element of FIG. 3*a;*
Figure 3E:
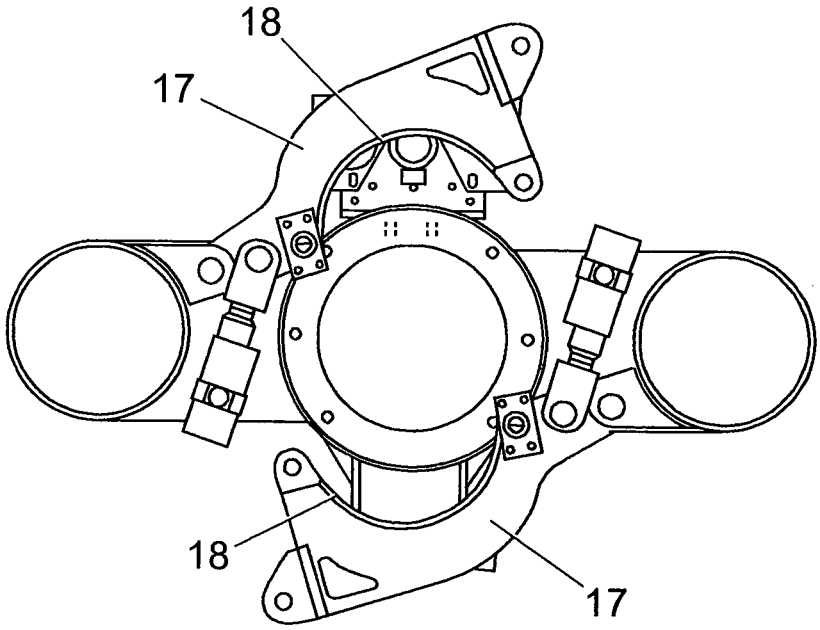
FIG. 3*e* is a schematic view of the locking mechanism of the first element of FIG. 3*a* in an open condition.
Figure 3D:
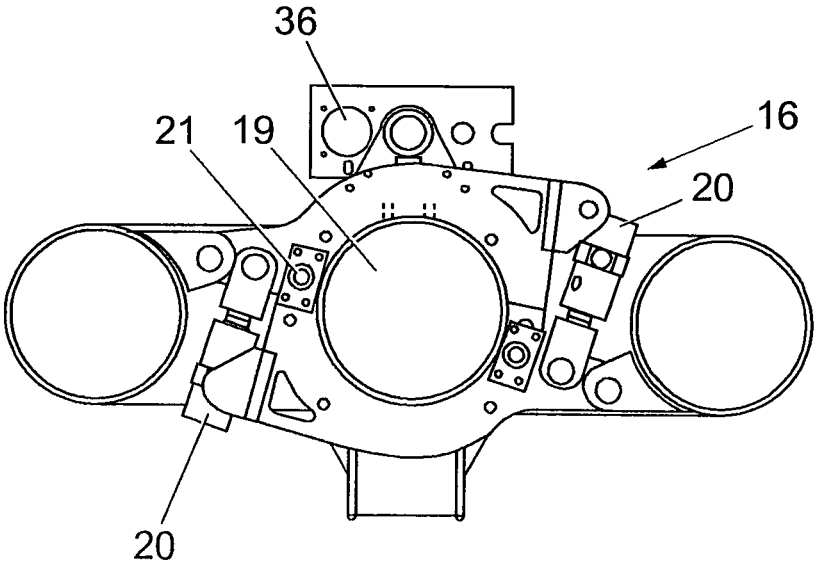
FIG. 3*d* is a schematic view of a locking mechanism of the first element of FIG. 3*a* in a locked condition.

The buoyant winching system is shown in more detail in FIG. 2 and in this embodiment comprises a frame 7 mounted between two buoyancy units 8, although the frame may be mounted on or to one or more buoyancy units in other embodiments. In the illustrated embodiment, the buoyancy units are substantially cylindrical and the frame is mounted between the long axes of the two buoyancy units. The buoyancy units may be removably mounted on or to the frame to facilitate storage when the winching system is in transit and also to allow a damaged unit to be easily replaced. In a further embodiment, the buoyant winching system or the winch structure itself may be inherently buoyant.

The winch 9 is carried on the frame. The winch comprises a reel 10 and one end of a winch line 11 is connected to the reel and the line is wound around the reel such that it can be selectively paid out and wound in by rotation of the reel as will be described below. Advantageously, the winch line is fed on to the reel through a static fairlead and the reel is driven axially to maintain the correct spooling of the winch onto the reel.

A motor 12 is mounted on the frame and in the preferred embodiment, the motor is mounted on the winch 9 for rotation and axial drive of the reel 10. The motor may be powered by a localised power supply mounted on the frame or alternatively may be powered via an umbilical from a remote location such as a vessel.

A yoke may be provided at one end of the frame or first body, preferably the front end in use, such that the winch line may be selectively guided by the yoke to prevent fouling of the winch line when the frame is being towed by a vessel.

A mechanism (not shown) may also be provided for severing or detaching the winch line once a connection operation is complete.

In the illustrated embodiment of FIG. 5, the buoyant winching system 2 is mounted on top of a marine structure 3 which comprises the first body to be connected to the second body.

In this embodiment the first element 5 of the latching mechanism is mounted beneath the marine structure and directly below the winch 9 The first element comprises a docking port comprising a receptacle 13 for receiving a second latching element as will be further described below.

The receptacle has an inner profile 14, which is adapted to assist in aligning the second latching element both axially and rotationally. The inner profile may comprise a slot. Means 15 may be provided for attaching the receptacle to the frame of the buoyant winching system.

Figure 4A:
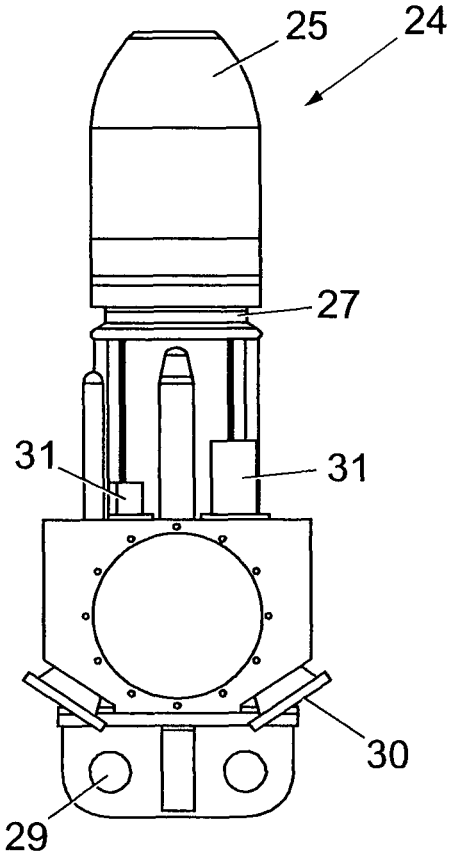
FIG. 4*a* is a view from one side of the turret of the connection system of FIG. 1.
Figure 4B:
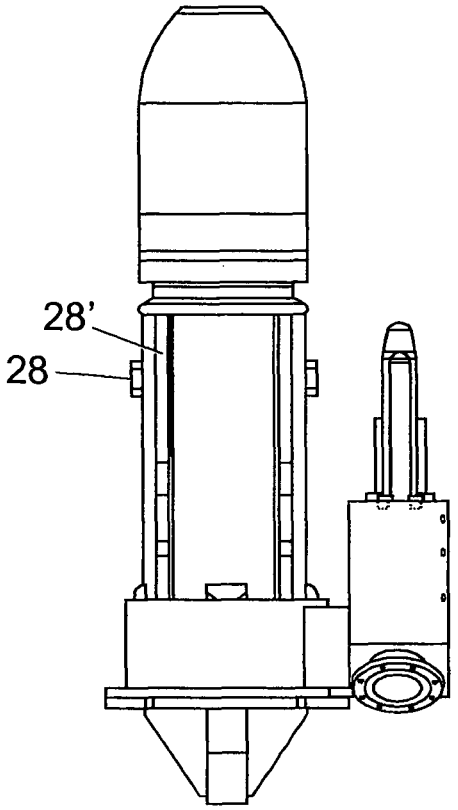
FIG. 4*b* is a view from the other side of the turret of FIG. 4*a;*

The receptacle further comprises a locking system 16 which may be remotely operated to secure the first and second latching elements together once the second latching element is docked within the receptacle. The locking system is shown in detail in FIGS. 4*d* and 4*e*. FIG. 4*d* illustrates the locking system in an open condition and FIG. 4*e* illustrates the locking system in a closed condition.

The locking system comprises a pair of mechanical arms 17 hingedly mounted on the top of the receptacle. Each arm has a concave recess 18 on the inner edge. The arms are mounted in opposed orientation such that the concave inner faces form a substantially circular aperture 19 when the mechanical arms are closed together.

Driving means are provided for operating the arms between an open and a closed position. In the embodiment shown, the driving means may be a hydraulic or pneumatic ram 20 mounted between each arm and the body of the receptacle.

A secondary mechanical locking system 21 may also be provided on the receptacle to provide a failsafe system for use in preventing accidental unlatching of the second latching element.

The present invention may be provided with a facility (not shown) for remotely viewing or otherwise obtaining confirmation of successful docking of a second element of the latching mechanism within the receptacle.

Means (not shown) may also be provided for connecting wiring, hosing or other umbilicals to and from the marine structure to the receptacle.

Means 36 may also be provided for the automatically connecting and disconnecting the subsea umbilicals from the second element of the latching mechanism to the receptacle. This may comprise a wet mate connector or sub sea plug. Docking of the connectors may take place during or after the docking operation to be described further below.

A shock absorber 22 is mounted on the body of the receptacle for absorbing shock loads during the docking process.

A fairlead 23 is mounted on or adjacent the bottom of the receptacle 13 to prevent fretting of the winch line during connection operations.

The second element of the latching mechanism is shown in more detail in FIG. 3. The second element comprises a shaped body 24 with a tapered upper surface 25 which is adapted to be received within the receptacle 13 of the first element.

An eye bolt (not shown) to enable connection of a tether line 26 may be provided on the second element, preferably at the top of the shaped body.

A means for establishing a mechanical connection with the first element of the latching mechanism is provided on the body of the second latching element. In the embodiment shown, the shaped body has an area of reduced diameter to form a waist 27, which is shown in this embodiment as being below the tapered upper surface of the body.

A key 28 and tapered strakes 28' are provided on the side of the body to align with the inner profile 14 of the receptacle to assist in rotational alignment of the second element within the receptacle.

The lower part of the body of the second element is provided with means for mechanically attaching mooring lines. The attachment means in the illustrated embodiment are apertures 29 through the lower part of the body.

One or more ports 30 for attaching umbilicals or cables is/are also provided on the lower part of the body. Means 31 may also be provided on the body of the second element for connecting and disconnecting umbilicals which dock into the ports to the first element of the latching mechanism. This may comprise an electrical connection or underwater plug. The connecting and disconnecting means may be remotely operated from the towing vessel.

The second element of the latching mechanism may be provided with inherent or inbuilt buoyancy or alternatively one or more buoyancy modules may be attached to the body of the second element to maintain the second element at a desired depth, off the seabed but below the surface when not in use.

The process steps of the preferred method for connecting the first and second elements of the latching mechanism together are illustrated in FIG. 5*a*-5*h*.

Figure 5A:
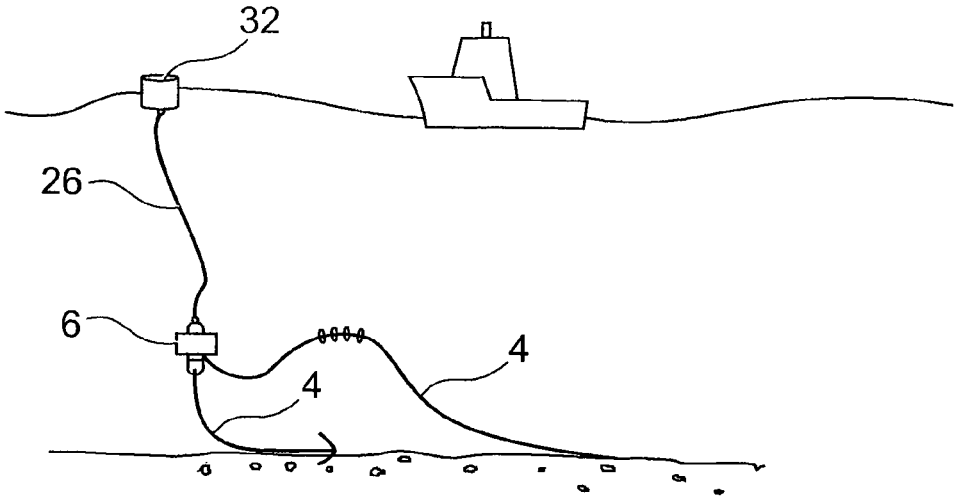
FIGS. 5*a* to 5*h* illustrate the connection sequence of the connection system of FIG. 1, and FIGS. 5*i* to 5*k* illustrate the disconnection sequence of the connection system of FIG. 1.

As shown in FIG. 5*a*, in an initial step, a cable or body 4 is connected to the second element 6 of the latching mechanism. The cable or body may be docked in one of the apertures 29 or ports 30 in the lower part of the body.

The second element 6 of the latching mechanism is connected to a location buoy 32 using a tether line 26. The location buoy merely identifies the position of the second element but does not support the weight of the element. The tether line is fed through the eye-bolt at the top of the body of the second element using a remotely operated vehicle. The buoyancy of the second element enables this element to take up a desired position above the sea bed but below the surface.

Figure 5B:
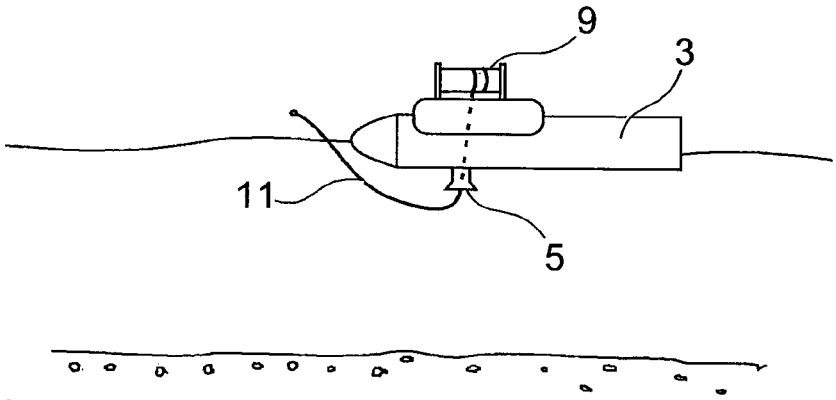

In FIG. 5*b*, the buoyant winching system 2 is mounted on top of a marine structure and the first element 5 of the latching mechanism is mounted beneath the marine structure, preferably immediately below the reel 10 of the winch. The winch line 11 is attached to the reel, wound around the reel and passed through both the marine structure and the receptacle 13 of the first element of the latching mechanism. An I-tube may be provided through the marine structure which the winch line may pass through.

Figure 5C:
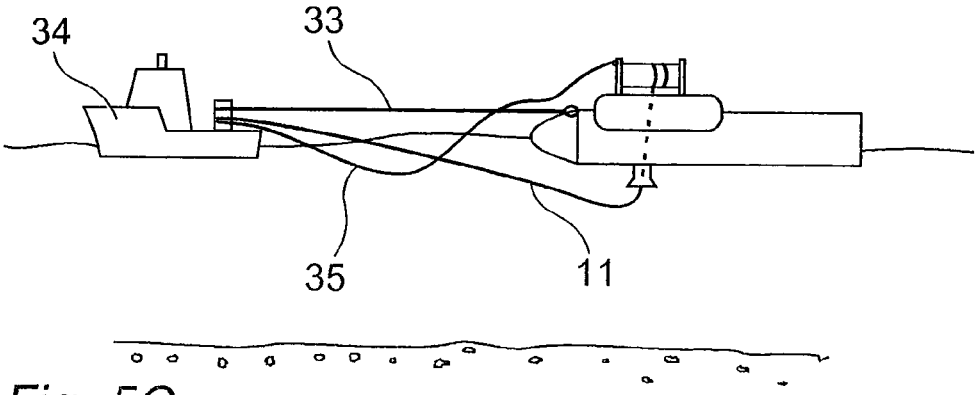

In the next step as illustrated in FIG. 5*c*, a tow line 33 is connected from the marine structure 3 to a vessel 34 such as a tug. A second line 35 for retrieval as will be described below is connected from the buoyant winching system 2 to the vessel. The winch line 11 is passed from the floating winch structure to the vessel. The free end of the winch line may be connected to a fixing point on the vessel. The steps illustrated in FIGS. 5*b* and 5*c* are preferably carried out at shore or in harbour although they may also be carried out on a calm day at sea.

The tow line 33 is shorter than the retrieval line 35 and the withdrawn length of the winch line 11 such that both the winch line and the retrieval line are slack, the only taut line being the tow line between the vessel and the frame. The marine structure 3 is maintained at an optimum distance from the vessel by the tow line to ensure that the winch line and retrieval line remain slack during the connection operation.

Figure 5D:
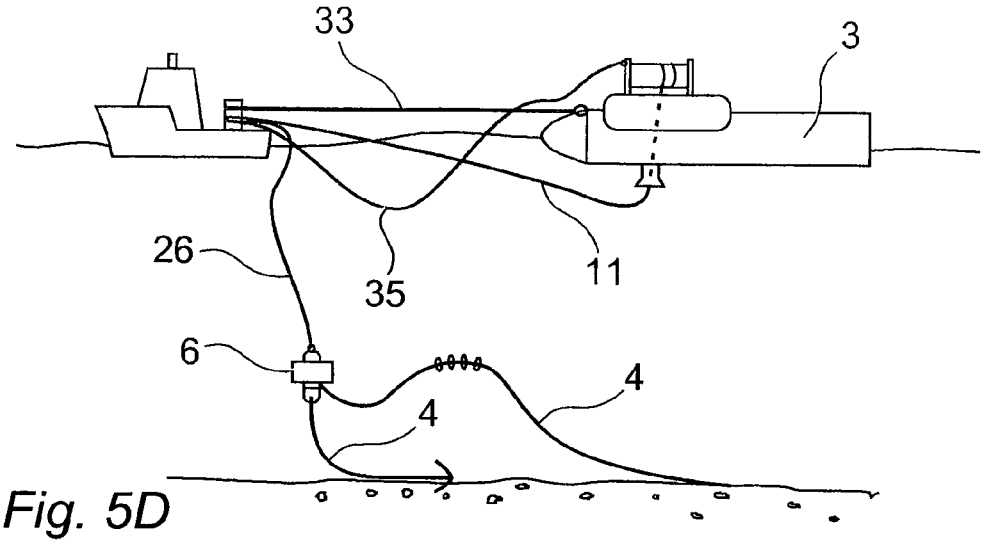

The vessel tows the marine structure 3 to its connection location as identified by the location buoy 32. The vessel retrieves the location buoy, removes it and connects the end of the tether line 26 to the end of the winch line 11 on board the vessel as illustrated in FIG. 5*d*.

Figure 5E:
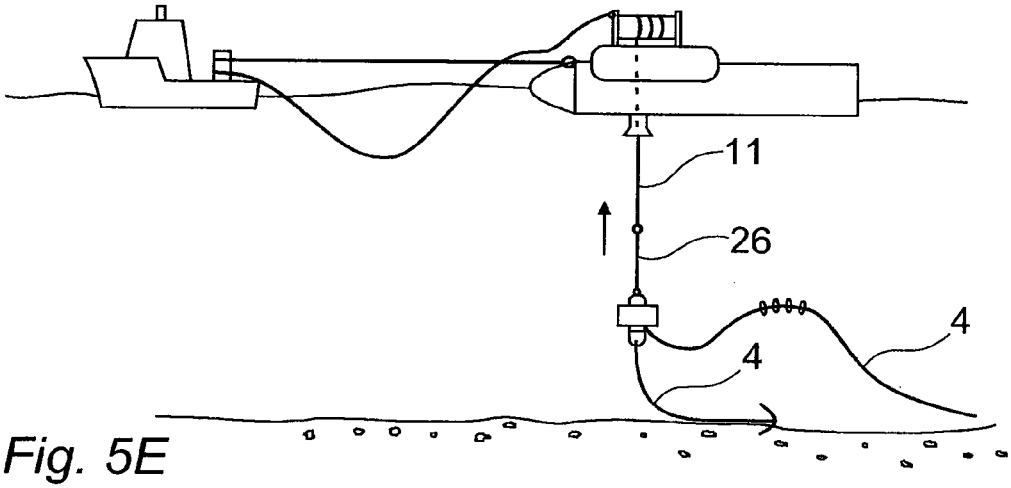

In the next step as illustrated in FIG. 5*e*, the connected tether line 26 and winch line 11 is thrown overboard. An operator located on the vessel activates the winch 9 on the marine structure remotely to begin winding the tether line and connected winch line on to the reel 10 of the winch and thereby to pull the second element 6 of the latching mechanism upwards towards the receptacle 13 of the first element. In the preferred embodiment, the winch reel is driven axially by the motor 12 to maintain the correct spooling of the winch line onto the reel.

As the second latching element approaches the receptacle of the first latching element, the tapered upper surface 25 of the first latching element enters the receptacle and the key 28 on the body of the second latching element engages in the inner profile 14 of the receptacle. The axial and rotation position of the first and second latching elements is therefore controlled as the elements are drawing together.

Upon docking of the second latching element within the receptacle of the first latching element, the mechanical arms 17 are operated to encircle the body of the second latching element in the region of the waisted area 27 of the body to securely connect the first and second latching elements together. The secondary locking mechanism is then activated to provide additional security.

Figure 5F:
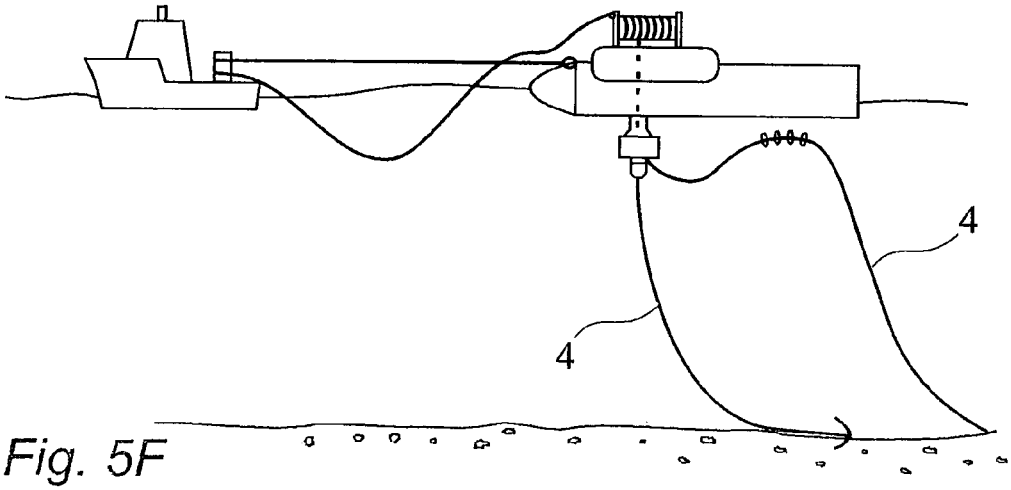

Docking of the shaped body 24 of the second element in the receptacle as shown in FIG. 5*f* is confirmed from the remote viewing system through proximity. The electrical power, signal and fluid power umbilical connections are made at the same time.

The winch 9 continues to pull tension on the winch line. Tension is increased until a weak connector is broken in the line or alternatively the line is severed.

Figure 5G:
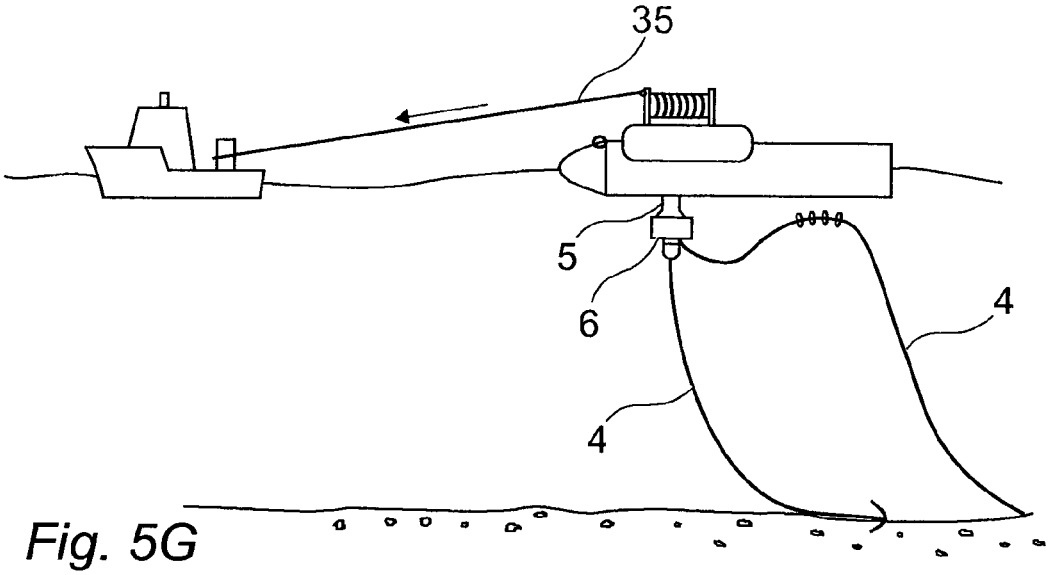

The tow line 33 is then released from the marine structure 3 by a remote operation carried out by an operator on the vessel (FIG. 5*g*).

Figure 5H:
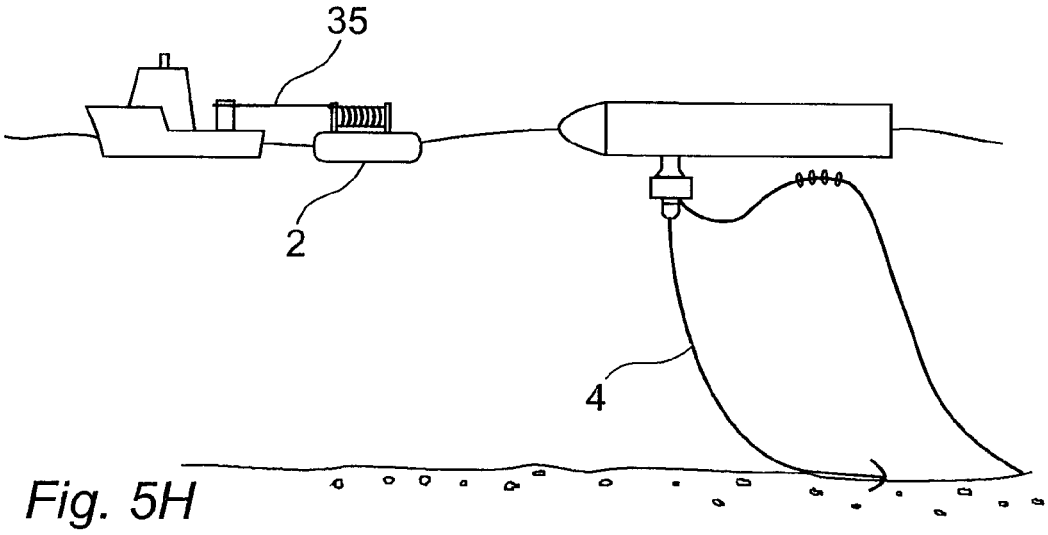
Figure 5I:
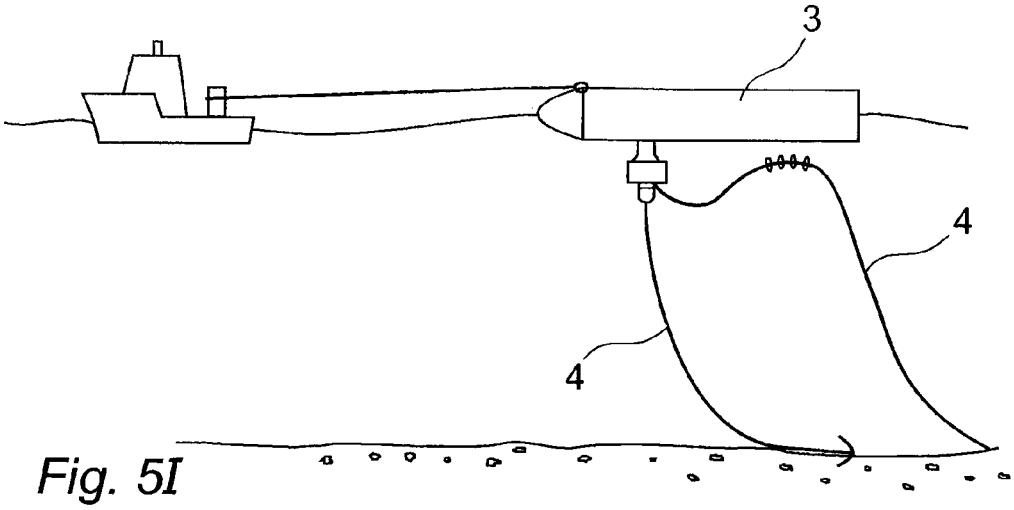
Figure 5J:
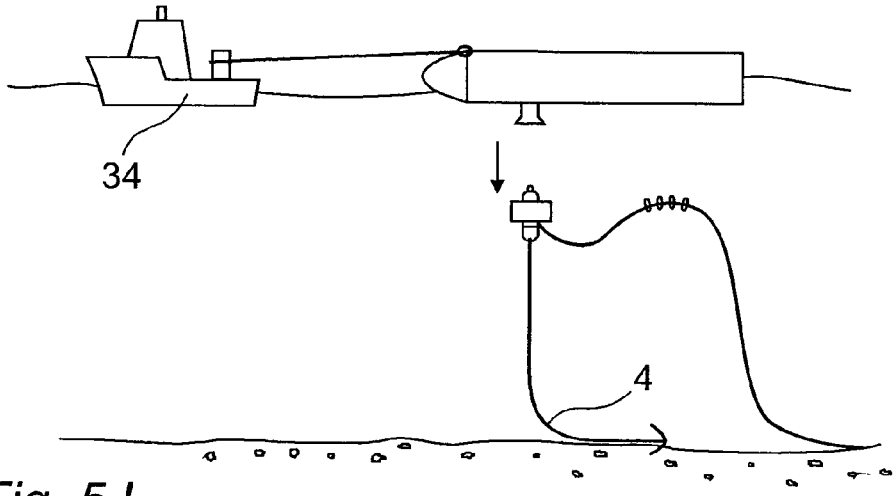

The buoyant winching system 2 is pulled off the marine structure 3 using the winch retrieval line 35 and is recovered to the vessel 33 or alternatively towed behind the vessel back to shore or harbour where it can be installed on the next marine structure (FIGS. 5*h* and 5*f*).

Disconnection of the connection system will now be described.

A vessel sails out to the location of the marine structure 3 and a tow line 33 is attached between the vessel and the frame in accordance with a known method.

Figure 5K:
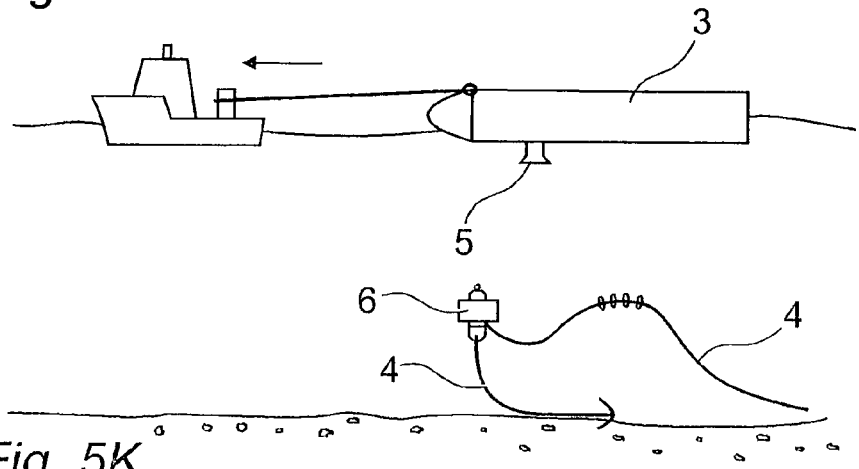

An operator on board the vessel remotely actives the latch trigger and the second element 6 of the latching mechanism is released from the receptacle 13 of the first element and drops away from the receptacle. The inherent buoyancy of the second element of the latching mechanism allows the mechanism to maintain a desired depth above the seabed but below the surface as described above. The marine structure 3 is then towed back to shore or harbour (FIG. 5*k*).

It will be apparent to a person of skill in the art that the present invention provides a connection method and connection system which enables connection of a first cable or body to a second cable or body using slack connection lines such that the method and system can be operated in moderate seas. This considerably widens the weather window within which the connection method and connection system can be operated.

Furthermore, by removably mounting the winch upon the floating platform, the winch may be recovered to the towing vessel once the connection between the first and second bodies is effected, thereby allowing the winch to be reused for further connection operations. This reduces the overall cost of the connection operation by reducing the number of components required for multiple connection operations.

Additionally, as the connection system of the preset invention can be operated remotely from a towing vessel, the connection system can be used in heavier seas and with shorter weather windows than currently available systems.

Modifications and alterations may be made to the present invention such as for example, in some embodiments instead of a local motor on the frame, power may be supplied from a remote vessel via an umbilical connected to the motor.

In a further embodiment of the present invention, the location buoy may be attached automatically to the second element of the latching mechanism upon release of the shaped body from the receptacle.

In a further embodiment of the present invention, the winch structure and/or buoyant winching system would be provided with means of hoisting itself, under operator control, to the preferred location on the marine structure.

Whilst the buoyant winching system and particularly the floating winch has been described as part of a connection and disconnection system, it is to be appreciated that the floating winch may be used in other marine operations where the winch may be temporarily mounted on or to a marine structure, operated as required and then removed from the marine structure. In some cases the winch may be towed or may be driven from location to location as required.

The invention claimed is:

1. A connection system comprising:

a first latching element mountable to a first body;

a second latching element mountable to a second body; and a buoyant winching system for drawing the first latching element and second latching element together to facilitate connection of the first body to the second body, which buoyant winching system comprises a winch comprising a frame and a buoyancy unit, the frame being mounted to the buoyancy unit such that the winch is adapted to be towed to an off-shore location by a towing vessel;

a winch line attached at one end to the winch of the buoyant winching system and connectable at another end to a tether line to which the second latching element is adapted to be connected;

a towing line connected between the first body and the towing vessel; and wherein the towing line is shorter than the winch line such that when a free end of the winch line is carried on the towing vessel, whilst the towing line is under tension, there is no tension in the winch line.

2. A connection system according to claim 1, wherein one of said first and second bodies is a marine structure and the buoyant winching system is mountable to said marine structure.

3. A connection system according to claim 2, wherein the buoyant winching system is removably mountable to said marine structure.

4. A connection system according to claim 1, wherein the winch line passes through the first latching element of the first body.

5. The connection system according to claim 1, comprising a motor for maintaining correct spooling of the winch line.

6. The connection system according to claim 1, wherein the first latching element comprises a socket mounted on the first body, and the second latching element comprises a plug locatable within the socket of the first latching element.

7. The connection system according to claim 1, comprising a key and a profile on the first latching element and the second latching element to enable correct axial and rotational alignment of the first latching element and the second latching element.

8. The connection system according to claim 1, wherein the second latching element is provided with buoyancy means to maintain the second latching element floating in an upright orientation at a chosen depth.

9. The connection system according to claim 1, wherein the buoyant winching system is remotely operable.

10. The connection system according to claim 1, wherein mechanical locking means are provided between the first latching element and the second latching element.

11. The connection system according to claim 10, wherein a further locking means is provided between the first latching element and the second latching element to avoid an unintentional disconnection of the first latching element and the second latching element.

12. The connection system according to claim 1, wherein the buoyant winching system is provided with at least one of a power supply and a communications system.

13. The connection system according to claim 12, wherein the communication system is routed through the marine structure.

14. The connection system according to claim 12, wherein the power supply of the winch can act as an auxiliary power source for the first body.

15. The connection system according to claim 1, wherein the first and second bodies include any combination or single function from a group comprising: an umbilical, for carrying electrical current, an optical fibre, for carrying an optical signal, a fluid transmission and a mechanical mooring.

16. The connection system according to claim 1, wherein the connection system includes a viewing system.

17. The connection system according to claim 16, wherein the viewing system relays images to an operator controlling the connection of the first body to the second body.

18. A connection method for connecting a first body carrying a first latching element to a second body carrying a second latching element, the connection method comprising the steps of:

connecting a winch line from a buoyant winching system through the first latching element to a tether line attached to the second latching element, wherein the buoyant winching system comprises a winch comprising a frame and a buoyancy unit, the frame being mounted to the buoyancy unit such that the winch is adapted to be towed to an off-shore location by a tug or other vessel;

operating the winch to draw the first latching element and second latching element together to connect the first body to the second body wherein the connection of the winch line to the tether line is carried out without tension in the winch line; and removing the buoyant winching system from the first body.

19. The connection method according to claim 18, wherein the first latching element and second latching element are mechanically locked together once they have been drawn together.

20. The connection method according to claim 18, wherein the method further comprises the step of disconnecting or severing the winch line once the first and second bodies are connected.

* * * * *

UNITED STATES PATENT AND TRADEMARK OFFICE

CERTIFICATE OF CORRECTION

PATENT NO. : 8,991,325 B2
APPLICATION NO. : 13/001647
DATED : March 31, 2015
INVENTOR(S) : Richard William Yemm et al.

It is certified that error appears in the above-identified patent and that said Letters Patent is hereby corrected as shown below:

On the Title Page:

After item (21) Insert --(22) PCT Filed: Jun. 25, 2009

(86) PCT No.:PCT/GB2009/050732

§371(c)(1),
(2), (4) Date: Mar. 7, 2011

(87) PCT Pub. No.: WO2010/004314

PCT Pub. Date: Jan. 14, 2010--

In the Claims:

| Patent | Application File |
|---|---|
| Column 8, Line 19, Claim 2 | Replace "A connection system" with --The connection system-- |
| Column 8, Line 23, Claim 3 | Replace "A connection system" with --The connection system-- |
| Column 8, Line 26, Claim 4 | Replace "A connection system" with --The connection system-- |
| Column 8, Lines 58-59, Claim 13 | Replace "is routed through the marine structure." with --is routed through a marine structure.-- |

Signed and Sealed this
Eleventh Day of August, 2015

Michelle K. Lee

Michelle K. Lee
*Director of the United States Patent and Trademark Office*

| | |
|---|---|
| Column 9, Lines 17-18, Claim 18 | Replace "operating the winch to draw the first latching element and second latching element together" with --operating the winch to draw the first latching element and the second latching element together-- |
| Column 9, Lines 23-24, Claim 19 | Replace "wherein the first latching element and second latching element" with --wherein the first latching element and the second latching element-- |